US006137454A

United States Patent [19]

Peck

[11] Patent Number: 6,137,454

[45] Date of Patent: Oct. 24, 2000

[54] UNFURLABLE SPARSE ARRAY REFLECTOR SYSTEM

[75] Inventor: Scott O. Peck, Palo Alto, Calif.

[73] Assignee: Space Systems/Loral, Inc., Palo Alto, Calif.

[21] Appl. No.: 09/392,081

[22] Filed: Sep. 8, 1999

[51] Int. Cl.[7] ..... H01Q 15/20

[52] U.S. Cl. ..... 343/912; 343/DIG. 2; 343/915

[58] Field of Search ..... 343/912, 915, 343/847, 705, 914, DIG. 2

[56] References Cited

U.S. PATENT DOCUMENTS 3,165,751 1/1965 Clark ..... 343/DIG. 2
4,811,034 3/1989 Kaminskas ..... 343/915
5,977,932 7/1997 Robinson ..... 343/895

*Primary Examiner*—Don Wong
*Assistant Examiner*—James Clinger
*Attorney, Agent, or Firm*—Kenneth W. Float

[57] ABSTRACT

An unfurlable reflector antenna system having one or more unfurlable arms that are each shaped in the form of a parabolic right cylinder when it is unfurled. Each arm comprises an RF reflecting membrane or a thin shell as the reflector structure. Each arm is coupled by way of a line feed to a receiver. The system is specifically designed for use on a spacecraft. Each arm may be stowed by flattening the parabolic membrane or shell, and then rolling up the arm, which is accomplished without stretching. The sparse reflector antenna array system is thus stowable in a compact configuration, yet easily unfurls to provide a very large diameter lightweight reflector.

16 Claims, 1 Drawing Sheet

UNFURLABLE SPARSE ARRAY REFLECTOR SYSTEM

BACKGROUND

The present invention relates generally to spacecraft antenna arrays, and more particularly, to an unfurlable sparse array reflector antenna system, such as may be used on a spacecraft.

The present invention addresses a need for a very large (100 meter diameter), reflector antenna array for use on a spacecraft. In general, very large antenna arrays have not heretofore been developed for use on spacecraft. A NASA Goldstorne ground-based antenna array uses multiple individual ground-located paraboloidal reflectors arranged in a Y-shaped configuration. However, deployment of such an antenna array in a space-based application would be relatively complicated. Furthermore, stowing of the multiple paraboloidal reflectors prior to deployment would be somewhat difficult.

Accordingly, it is an objective of the present invention to provide for an improved sparse array reflector antenna system that may be used on a spacecraft. It is a further objective of the present invention to provide for an unfurlable sparse array reflector antenna system for use on a spacecraft.

SUMMARY OF THE INVENTION

To accomplish the above and other objectives, an unfurlable sparse array reflector antenna system that may be used on a spacecraft and that comprises one or more unfurlable RF reflecting arms that are each shaped as a parabolic right cylinder when it is unfurled. An exemplary embodiment of the present invention comprises an unfurlable, very large (100 meter diameter), Y-shaped sparse reflector antenna array. The unfurlable sparse array reflector antenna system is specifically designed to receive radio frequencies on the spacecraft. The unfurlable sparse reflector antenna array has a lightweight structure that provides for near solid surface reflector accuracy.

Rather than using a linear array of individual paraboloidal reflectors, each arm of the unfurlable sparse array reflector antenna system is a parabolic right cylinder. The parabolic right cylinder has a greater surface area than a collection of individual elements, and may use a single line feed for each arm. This configuration provides a highly efficient system for signal collection. A three arm array may be used in a typical application, although fewer or more arms may readily be used, depending upon the application.

The unfurlable sparse array reflector antenna system uses a membrane or a thin shell as the reflector structure. Each arm may be compactly stowed for launch by first flattening the parabola then rolling up the arm toward the spacecraft. Each of these motions is accomplished without stretching the surface of the membrane or thin shell since they fall into the class of isometric surface mappings. Since only bending deformation is involved in stowing the array, the surface of each arm is preferably made as thin as possible, while maintaining the antenna surface configuration. The unfurlable sparse array reflector antenna system is stowable in a compact configuration, yet easily unfurls to provide a very large diameter lightweight reflector.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
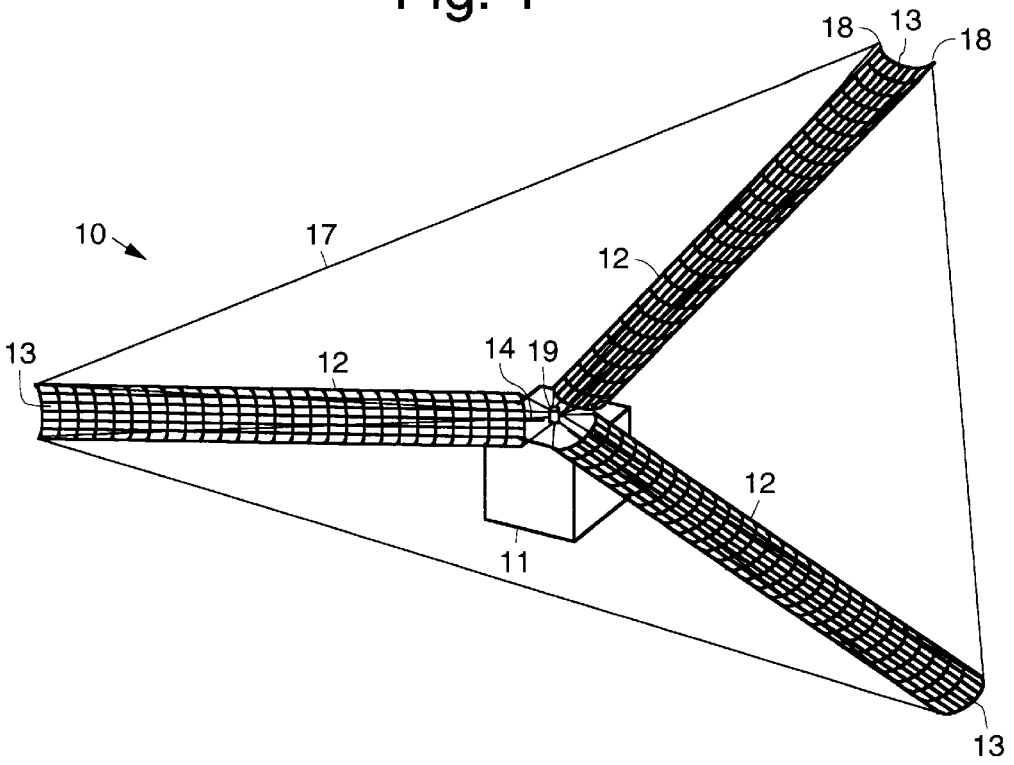
FIG. 1 illustrates an exemplary embodiment of an unfurlable sparse array reflector antenna system in accordance with the principles of the present invention, shown in a deployed condition.
Figure 2:
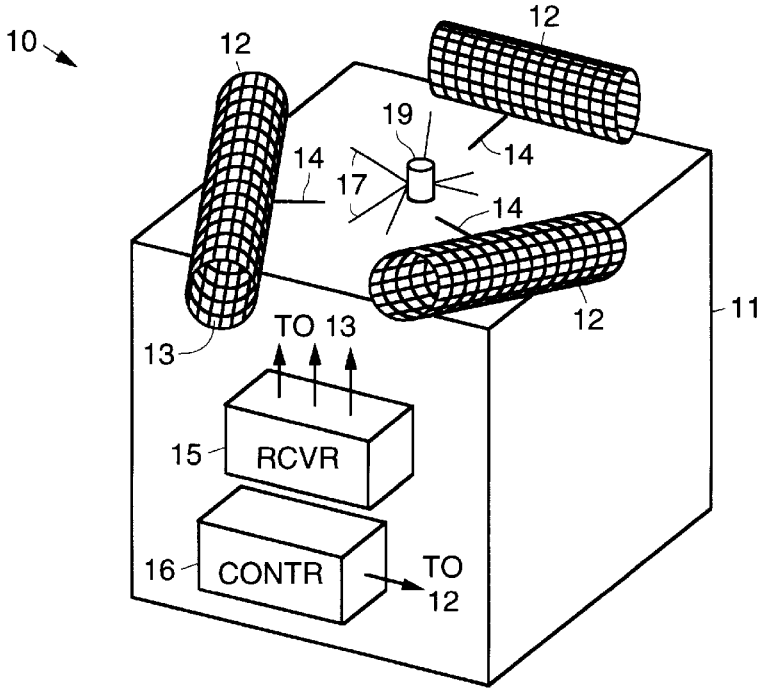
FIG. 2 illustrates the exemplary unfurlable sparse array reflector antenna system in a stowed condition.

Referring again to the drawing figures, FIG. 1 illustrates an exemplary embodiment of an unfurlable sparse array reflector antenna system 10 in accordance with the principles of the present invention, shown in a deployed condition. Certain details of the system 10 are shown in FIG. 2. The unfurlable sparse reflector antenna array system 10 may advantageously be used on a spacecraft 11, although the antenna array may be used in other applications that require stowage and subsequent deployment of the antenna array system 10.

FIG. 1 illustrates an exemplary unfurlable, very large (100 meter diameter, for example), Y-shaped sparse reflector antenna array system 10. The unfurlable sparse reflector antenna array system 10 comprises one or more unfurlable RF reflecting arms 12 that are each shaped in the form of a parabolic right cylinder when it is unfurled. An exemplary three arm array system 10 is illustrated in FIG. 1 may be used in a typical application, although more arms 12 may readily be used, or a single linear arm 12 or arms 12 may be used, depending upon the application.

Each arm 12 of the unfurlable sparse reflector antenna array system 10 comprises a membrane 13 or a thin shell 13 as the reflector structure. For example, the membrane 13 or thin shell 13 may be comprised of graphite which is reflective at RF frequencies, or may be comprised of reflective metal (copper, for example) patterns disposed on a polyimide material. The unfurlable RF reflecting arms 12 may be designed to be reflective at any suitable frequency band, such as L, X, C, Ku or Ka bands, for example.

Each arm 12 is shaped as a parabolic right cylinder. The parabolic right cylinder shape of each membrane 13 or thin shell 13 has a greater surface area than a collection of individual reflector elements. Each arm 12 is coupled to a line feed 14 that couples received energy to a receiver (RCVR) 15 (FIG. 2) onboard the spacecraft 11. This configuration provides a highly efficient system 10 that provides for signal collection.

The stowed configuration of the unfurlable sparse reflector antenna array system 10 is shown in FIG. 2. The stored energy derived from the rolling process is sufficient to deploy the arms 12, requiring only a controller (CONTR) 16 that is used to release the arms 12 from their stowed positions. Alternatively, smart material solutions such as shape memory alloys or inflatable tubes may be employed to effect deployment of the arms 12. Once the arms 12 are deplored, simple controlled tension lines 17 (FIG. 1) coupled between tips 18 of the arms 12 and between the tips 18 and a central king pin 19 located on the spacecraft 11 may be used to maintain the shape of the antenna array system 10, which is also shown in FIG. 1. The king pin 19 is a pin that is raised with respect to the plane of the arms 12 of the unfurlable sparse reflector antenna array system 10. The king pin 19 and controlled tension lines 17 are used to control out-of-plane deviations in the shape of the antenna array system 10.

Each arm 12 may be compactly stowed for launch by first flattening the parabolic membrane 13, and then rolling up the arm 12 toward the spacecraft 11. Each of these motions may be accomplished without stretching the surface of the membrane 13 or thin shell 13, since they are isometric surface mappings. Since only bending deformation is involved in stowing the antenna array system 10, the surface of each arm 12 is preferably made as thin as possible, while maintaining the desired antenna surface configuration. The sparse reflector antenna array system 10 is thus stowable in a compact configuration, yet easily unfurls to provide a very large diameter lightweight reflector.

The unfurlable sparse reflector antenna array system 10 is specifically designed to receive radio frequencies on the spacecraft 11. The unfurlable sparse reflector antenna array system 10 has a lightweight structure that provides for near solid surface reflector accuracy.

Thus, an unfurlable sparse reflector antenna array system has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. An unfurlable sparse reflector antenna array system comprising:

one or more unfurlable RF reflecting arms, each shaped as a parabolic right cylinder when it is unfurled; and a line feed coupled to each arm.

2. The antenna array system recited in claim 1 which is disposed on a spacecraft.

3. The antenna array system recited in claim 1 wherein the arms comprise a plurality of arms configured in a Y-shape.

4. The antenna array system recited in claim 1 wherein the one or more arms comprise a parabolic membrane.

5. The antenna array system recited in claim 1 wherein the one or more arms comprise a parabolic thin shell.

6. The antenna array system recited in claim 1 further comprising a controller for releasing the one or more arms from a stowed position.

7. The antenna array system recited in claim 1 wherein the one or more arms each comprise a memory alloy that unfurls to the parabolic shape when they are unfurled.

8. The antenna array system recited in claim 1 wherein the one or more arms each comprise one or more inflatable tubes that unfurls to the parabolic shape when they are unfurled.

9. The antenna array system recited in claim 1 further comprising controlled tension lines coupled between tips of the one or more arms and between the tips and a central pin for maintaining the shape of the array.

10. An unfurlable sparse reflector antenna array system for use on a spacecraft, comprising:

one or more unfurlable RF reflecting arms disposed on the spacecraft that are each shaped as a parabolic right cylinder when it is unfurled; and a line feed coupled to each arm.

11. The antenna array system recited in claim 9 wherein the arms comprise a plurality of arms configured in a Y-shape.

12. The antenna array system recited in claim 9 wherein the one or more arms comprise a parabolic membrane.

13. The antenna array system recited in claim 9 wherein the one or more arms comprise a parabolic thin shell.

14. The antenna array system recited in claim 9 further comprising a controller for releasing the one or more arms from a stowed positions.

15. The antenna array system recited in claim 9 wherein the one or more arms comprise a memory alloy that unfurls the one or more arms to the parabolic shape when they are unfurled.

16. The antenna array system recited in claim 9 further comprising a plurality of controlled tension lines coupled between tips of the one or more arms and between the tips and a central pin located on the spacecraft for maintaining the shape of the array.

* * * * *